US006090488A

United States Patent [19]

Kweon

[11] Patent Number: 6,090,488

[45] Date of Patent: Jul. 18, 2000

[54] TAPERED TOOTHBRUSH BRISTLE AND TOOTHBRUSH WITH SAID BRISTLES, AND METHODS FOR PRODUCING THE SAME

[75] Inventor: Young Jun Kweon, 201-7 Heukseok 1dong, Dongjak-ku, Seoul 156-071, Rep. of Korea

[73] Assignees: Cheil Jedant Corporation; Young Jun Kweon, both of Seoul, Rep. of Korea

[21] Appl. No.: 09/137,679

[22] Filed: Aug. 21, 1998

[30] Foreign Application Priority Data

Mar. 19, 1998 [KR] Rep. of Korea ..... 98-9475

[51] Int. Cl.[7] ..... D02G 3/00; A46B 9/04

[52] U.S. Cl. ..... 428/399; 428/401; 15/167.1

[58] Field of Search ..... 428/399, 401; 15/167.1

[56] References Cited

U.S. PATENT DOCUMENTS

| | | | |
|---|---|---|---|
| 4,010,509 | 3/1977 | Huish | 15/167 R |
| 4,738,001 | 4/1988 | Shipp | 15/106 |
| 5,052,070 | 10/1991 | Klugmann | 15/159 A |
| 5,144,712 | 9/1992 | Hansel et al. | 15/167.1 |
| 5,398,367 | 3/1995 | Lu | 15/167.1 |
| 5,933,908 | 8/1999 | O'Brien | 15/207.2 |

*Primary Examiner*—N. Edwards
*Attorney, Agent, or Firm*—Burns, Doane, Swecker & Mathis, L.L.P.

[57] ABSTRACT

A tapered bristle for a toothbrush which is tapered starting at 10 mm or less, preferably 3–5 mm, from the end of the bristle, characterized in that the tapered end of the bristle ranges from 0.04 mm to 0.08 mm in diameter, is disclosed. A toothbrush tufted with said tapered bristles is also disclosed. In addition, methods for producing said tapered bristle or said toothbrush are disclosed.

2 Claims, 2 Drawing Sheets

TAPERED TOOTHBRUSH BRISTLE AND TOOTHBRUSH WITH SAID BRISTLES, AND METHODS FOR PRODUCING THE SAME

BACKGROUND OF THE INVENTION

1. Field of the Invention

The present invention relates to a tapered bristle for a toothbrush, and a toothbrush with a tuft of tapered bristles. In addition, the present invention relates to methods for producing said tapered bristle or said toothbrush.

2. Description of the Prior Art

The filament generally used for toothbrush bristles is made from nylon The advantages of nylon-made filament are its proper flexibility and softness. However, the disadvantages of nylon-made filament are that it is very water-absorbent and easily deformed. Typically, nylon-made bristle ends of toothbrushes are rounded off, as shown in FIG. 1, so that damage to the gums is avoided during brushing.

Polyester compounds such as polybutylene telephthalate (hereinafter PBT) and polyethylene terephthalate (hereinafter PET) may be used as the filament for toothbrush bristles. PBT and PET are better than nylon for toothbrush bristles in that they are cheaper, more durable, and less water-absorbent. However, PBT and PET are too stiff and inflexible, and thus, not soft. As such, since it appears that toothbrush bristles me from PBT or PET damage the gums, PBT or PET usually have been used only in inexpensive disposable toothbrushes, or in combination with nylon-made bristles, as a way to reduce the cost.

A process for tapering off the ends of PBT or PET-made bristles resulting in a needle-shape was suggested as a way to eliminate the disadvantages of PBT or PET while keeping the advantages. Typically, this was done mechanically by tapering off the bristle ends with the blade of a knife or with a rounding machine. This mechanical process produces tapered bristle with ends being only rounded, as shown in FIG. 2. However, it is impossible to produce tapered bristle with ends being needle-like by the mechanical process. Therefore, the mechanical process failed to sufficiently diminish the cited disadvantages of PBT or PET.

To produce PBT or PET-made toothbrush bristles with needle-like highly tapered ends, a method for tapering off the ends of said bristles using a sulfuric acid solution was developed by the present inventor and was patented as Korean Patent No. 130932, the disclosure of which is incorporated herein by reference. This technique comprises (i) cutting PBT or PET filament so that from about 1 mm to about 4 mm is extended from the desired length of bristles, (ii) soaking one end of the cut filament vertically in from 60% to 98% sulfuric acid solution at a temperature of from 80° C. to 200° C. by the length of from about 8 mm to about 9 mm, followed by treating another end of the filament in the same manner, (iii) cooling the resulting appropriately tapered filament in cold water, (iv) neutralizing the filament with from 30% to 70% sodium hydroxide or potassium hydroxide solution, (v) washing the filament with water and (vi) drying the filament. The resulting filament was shortened as originally cut, and each end was 0.03 mm or less in diameter, appearing needle-like, as shown in FIG. 3. This form is described as "highly tapered".

The stiffness of PBT or PET-made highly tapered bristles produced by the technique of the cited patent was considerably decreased, and thereby, the bristles were made soft and did not damage the gums during brushing. Moreover, plaque in periodontal pockets could be removed by the highly tapered bristles during brushing. However, toothbrushes with highly tapered bristles exhibited the following disadvantages:

(1) Since the highly tapered bristles were prepared using chemical reagent, the tapering was too sensitive to operative conditions such as the concentration of the reagent used, the temperature, the duration of soaking, etc. and the ends of the highly tapered bristles were not uniform to a high frequency. That is, it was very difficult to obtain the highly tapered bristles with ends being uniform. As a result, an inferior product was produced in as many as half the attempts i.e, at least 50% of products were a loss.

(2) The highly tapered bristles were felt too soft by consumers who were used to the proper flexibility of nylon-made bristles. The resulting feeling while brushing was evaluated lowly.

(3) Although the highly tapered bristles could remove plaque in periodontal pockets better than the prior rounded or tapered bristles, their capability of removing plaque was evaluated substantially less than that expected.

(4) Where the highly tapered bristles were more than 11.5 mm in length, they tended to be easily deformed during brushing.

Therefore, it is necessary to develop a PBT or PET-made highly tapered bristle that exhibits improved softness and durability, while more effectively removing plaque. At the same time, there is an urgent need to remarkably reduce the inferior goods rate, thereby lessening the cost of production.

SUMMARY OF THE INVENTION

In one aspect, the present invention provides a tapered toothbrush bristle which is tapered starting at 10 mm or less, preferably 3–5 mm, from the end of the bristle, characterized in that the tapered end of the bristle ranges from 0.04 mm to 0.08 mm in diameter.

In another aspect, the present invention provides a toothbrush with tapered bristles each of which is tapered starting at 10 mm or less, preferably 3–5 mm, from the end of the bristle, with the tapered end of the bristle ranging from 0.04 mm to 0.08 mm in diameter.

In another aspect the present invention provides a method for producing a tapered toothbrush bristle which is tapered starting at 10 mm or less, preferably 3–5 mm, from the end of the bristle, with the tapered end of the bristle ranging from 0.04 mmn to 0.08 mm in diameter, comprising (i) cutting PBT or PET bristle at the desired length, (ii) soaking the cut bristle vertically in a strong alkaline or acidic solution by the length of 10 mm or less from the end of the bristle until the tapered end of from 0.10 mm to 0.15 mm in diameter forms while the length of the bristle remains unchanged or slightly elongated, (iii) washing the resulting tapered bristle with water, (iv) drying the washed tapered bristle, (v) optionally trimming the end of the bristle, and (vi) rounding the end to obtain said tapered bristle.

In another aspect, the present invention provides a method for producing a toothbrush with tapered bristles each of which is tapered starting at 10 mm or less, preferably 3–5 mm, from the end of the bristle, with the tapered end of the bristle ranging from 0.04 mm to 0.08 mm in diameter, comprising (i) cutting PBT or PET bristles at the desired length, (ii) soaking one end of the cut bristles vertically in a strong alkaline or acidic solution by the length of 10 mm or less from the ends until the tapered end of from 0.10 mm to 0.15 mm diameter forms while the length of the bristle remain unchanged or slightly elongated, (iii) soaking an opposite end of the cut bristles vertically in a strong alkaline or acidic solution by the length of 10 mm in or less from the ends until the tapered end of from 0.10 mm to 0.15 mm in diameter forms while the length of the bristle remain unchanged or slightly elongated, (iv) washing the resulting both ends-tapered bristles with water, (vi) drying the washed tapered bristles, (vii) tufting the dried bristles into the head of a toothbrush, (viii) optionally to the ends of the bristles, and (ix) rounding the ends of the bristles to obtain said toothbrush.

DETAILED DESCRIPTION OF THE INVENTION

It is commonly known that the appropriate filaments used in the preparation of the toothbrush bristles are between 0.19 mm and 0.2 mm in diameter. The present invention will be described below based on such common knowledge. However, it will be recognized by those skilled in the art that various modifications can be made within the sprit of the present invention.

Figure 1:
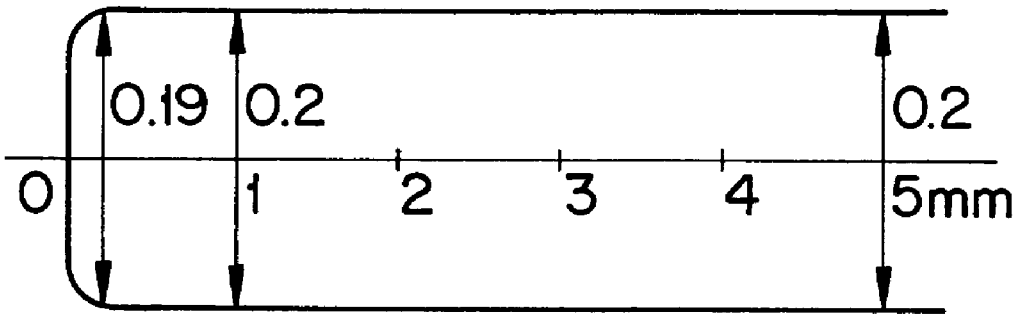
FIG. 1 shows a frontal sectional view of a nylon-made rounded toothbrush bristle end according to the prior art.
Figure 2:
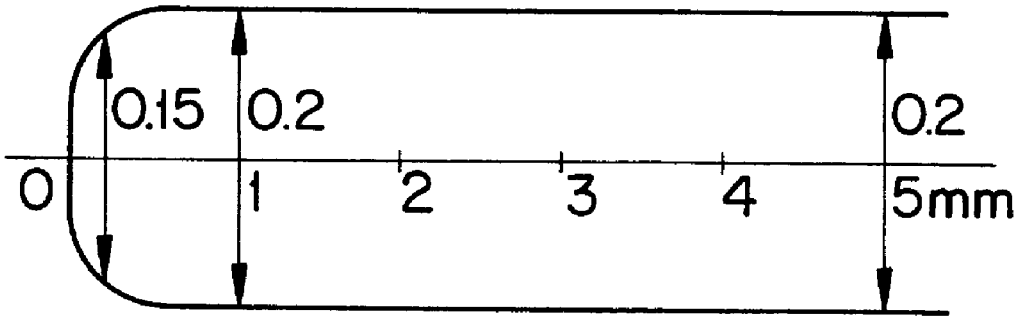
FIG. 2 shows a frontal sectional view of a PBT or PET-made mechanically tapered toothbrush bristle end according to the prior art.
Figure 3:
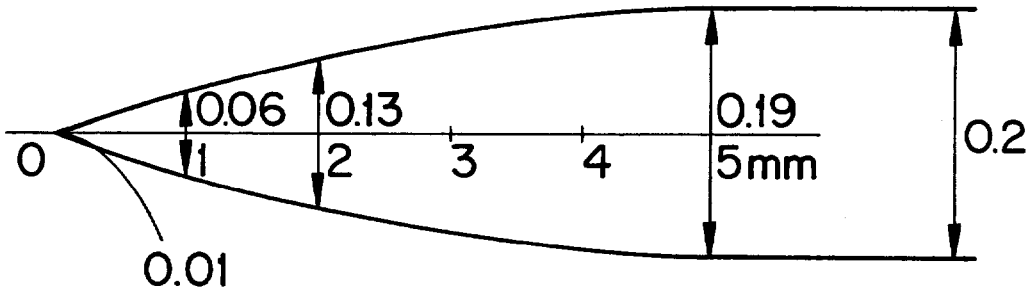
FIG. 3 shows a frontal sectional view of a PBT or PET-made chemically highly tapered toothbrush bristle end according to the prior art.
Figure 4:
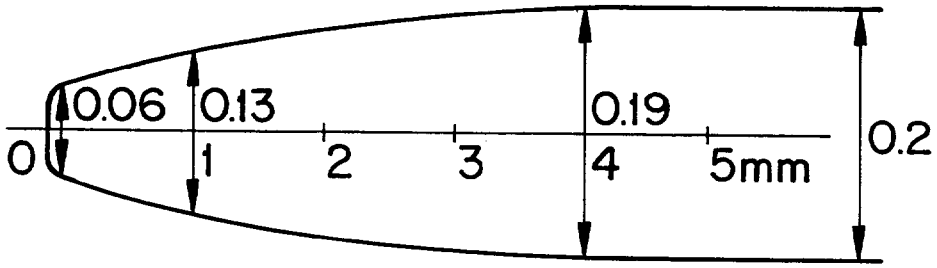
FIG. 4 shows a frontal sectional view of a PBT or PET-made chemically and mechanically highly tapered toothbrush bristle end according to the present invention.

Needle-like ends form while the PBT or PET-made bristles are gradually melted in a strong alkaline or acidic solution As shown in FIG. 3, the ends of the PBT or PET-made highly tapered bristles made by a chemical method as in the cited patent technique are less than 0.03 mm in diameter. As such, it is very difficult to establish an end point, and the ends of the highly tapered bristles may be melted instantly and nonhomogeneously, so that the bristles are not uniform in length and the ends are irregular in diameter. Moreover, where the bristles are too early taken out from the solution prior to forming the end of 0.03 mm or less in diameter, the resulting bristles are longer than desired and thus most are useless.

Furthermore, when a bundle of toothbrush bristles, about 50 mm in diameter, is soaked in a chemical reagent solution, the tapering level of the central bristles is typically different from that of the outer bristles. This will further reduce the production rate of the highly tapered bristles. As a result, the production cost of the highly tapered bristles is at least five times as high as typically end-rounded bristles.

According to the present invention, the bristles cut at the desired length are soaked vertically in a strong alkaline or acidic solution and taken out from the solution before the bristles are melted to form tapered ends of from 0.10 mm to 0.15 mm in diameter. The resulting bristle ends remain unmelted away. That is, when the bristles are taken out from the solution, the length of the bristles remains unchanged or slightly elongated and the ends of the bristles are between 0.10 mm and 0.15 mm in diameter. Therefore, it is possible to take out the bristles from the solution at any times when the tapered ends are formed. This means that the operative conditions such as the type or concentration of the reagent used, the temperature, the duration of soaking and the like can be more varied.

The tapering of the bristles according to the present invention is made over a shorter period. Where the bristles are treated as a bundle, the present invention can prevent the outer and central bristles from being unequally melted in the strong alkaline or acidic solution, e.g., the length of the outer bristles from being made shorter than the length of the central bristles. The resulting bundled tapered bristles following the soaking are relatively uniform.

Inorganic solvents can be used to taper off the PBT or PET bristles. Examples of the inorganic solvent include sodium hydroxide, potassium hydroxide, sulfuric acid and the like. Preferred is sodium hydroxide or sulfuric acid. It is especially preferred to use sulfuric acid. In addition, organic solvents can be used to taper off the PBT or PET bristles. Examples of the organic solvent include m-cresol, trifluoroacetic acid, o-chlorophenol, trichlorophenol, phenol, a mixture of phenol and tetrachloroethane and the like.

The temperature of the solution for tapering the PBT or PET bristles depends on the type of the selected solvent and can be varied. Typically, any solutions may be heated to a temperature of from 80° C. to 200° C. before the bristles are soaked in the solution.

The concentration of the solution can be adjusted depending on the temperature, the reactivity, the duration of soaking and the like. For example, sulfuric acid can be used at a concentration of from 60% to 98% at a temperature of from 80° C. to 200° C.

If desired, the ends of the bristles after being melted in an alkaline or acidic solution may be trimmed prior to rounding the ends. Whether to trim the ends can be easily determined by observing the state of the ends with a magnifier after being taken out from the solution.

In the present invention, it is necessary to round the bristle ends after being melted in an alkaline or acidic solution. This rounding can be carried out by conventionally known methods, for example using a 240# mesh paper. The rounding of the present invention is done until the ends of the tapered bristles are between 0.04 mm and 0.08 mm, preferably 0.06 mm in diameter. The tapering starts at less than 10 mm, preferably 3 mm to 5 mm, from the ends of the bristles.

When the toothbrush is manufactured by the present invention, the tapered bristle ends can be rounded before or after the bristles are tufted into the head of the toothbrush. The sequence between the rounding step and the tufting step is not critical since it does not affect the production rate.

The following examples are given merely as illustrations of the present invention and demonstration of the preferred embodiments of the present invention, and are not to be considered as limiting.

EXAMPLE 1

A 80% sulfuric acid solution was placed into a 1,000 ml beaker with a sandbags to fill by 1 cm from the bottom of the beaker and was heated to a temperature of 120° C. A bundle of PBT(520) filaments, each being 0.2 mm in 10 diameter, manufactured by TORAY CO., Japan, were cut to 30 mm in length. A 6 mm end of the bundle was soaked vertically in said sulfuric acid solution. After 10 minutes passed from the soaking, a filament was picked up with a pincette and the melted end was observed with a magnifier at intervals of 2 minutes. The temperature of the solution was kept at 120° C. After about 17 minutes passed from the soaking, the tapered bristles were taken out from the solution. Subsequently, the opposite 6 mm ends of the bundled filaments were tapered in the same manner as above. Both ends having been tapered, the filaments were completely cleansed with water, tied together with a rubber band and dried. The dried filaments were folded at the center, and the ends were trimmed and rounded using a TR89 Bristle Rounding Machine with 240# mesh paper, manufactured by Tsujumura Co., Japan to obtain tapered bristles which were 14.5 mm in length, with ends being about 0.05 mm in diameter.

EXAMPLE 2

A 50% NaOH solution was placed into a 1000 ml beaker with a sandbath to fill by 1 cm from the bottom of the beaker. The temperature of the solution was kept at 120° C. A bundle of PBT(520) filaments, each being 0.2 mm in diameter, manufactured by TORAY CO., Japan. were cut to 30 mm in length. A 4 mm end of the bundle was soaked vertically in the solution. After 10 minutes passed from the soaking, a filament was picked up with a pincette and the melted end was observed with a magnifier at intervals of 2 minutes. After 18 minutes passed from the soaking, the ends of the bristles were at the point of melting so that the length of the bristles was to be shortened. At that instant, the bundled filaments were taken out from the solution. Subsequently, the opposite 4 mm ends of the filaments were treated in the same manner as above. The filaments tapered at both ends were completely cleansed with water, tied together with a rubber band, and dried. The dried filaments were tufted into the head of a toothbrush using a LPB Tufting Machine manufactured by Tsujimura Co., Japan. The ends were trimmed and rounded using a TR89 Bristle Rounding Machine with 240# mesh paper, manufactured by Tsujumura Co., Japan to obtain a toothbrush with tapered bristles which were 11 mm in length, with ends being about 0.06 mm in diameter.

EXAMPLE 3

A bundle of Bacte Killer filaments, each 0.2 mm in diameter, manufactured by KANEBO Co., Japan, was cut to 30 mm in length. A 98% sulfuric acid solution was placed into a 1000 ml beaker with a sandbath to fill by 1 cm from the bottom of the beaker and the temperature of the solution was adjusted to 120° C. A 6 mm end of the bundle was soaked vertically in the solution. After 10 minutes passed from the soaking, a filament was picked up with a pincette and the melted end was observed with a magnifier at intervals of 2 minutes. After 16 minutes passed from the soaking, the bundled filaments were taken out from the solution. Subsequently, the opposite 6 mm ends of the filaments were treated in the same manner as above. The tapered filaments were soaked in 20% NaOH solution for 2 hours and sufficiently washed with water. The drying, tufting, trimming, and rounding were carried out in the same manner as described in Example 2 to obtain a toothbrush with tapered bristles which were 11 mm in length, with ends being about 0.05 in diameter.

COMPARATIVE EXAMPLE 1

A 98% sulfuric acid solution was placed into a 1000 ml beaker with a sandbath to fill by 1 cm from the bottom of the beaker. The temperature of the solution was kept at 120° C. A bundle of PBT(520) filaments, each being 0.2 mm in diameter, manufactured by TORAY CO., Japan, were cut to 30 mm in length. An 8 mm end of the bundle was soaked vertically in the solution. After 10 minutes passed from the soaking, a filament was picked up with a pincette and the melted end was observed with a magnifier at intervals of 2 minutes. After about 21 minutes passed from the soaking, the ends of the bristles were melted so that the length of the bristles was shortened. At that instant, the resulting highly tapered filaments were taken out from the solution. The filaments were cooled in cold water for 30 minutes. Subsequently, the opposite 8 mm ends of the filaments were treated in the same manner as above. Then, the highly tapered ends were soaked in a mixture of 30% sodium hydroxide solution and 0.5% acetone for 2 hours. The filaments, highly tapered at both ends, were then cooled in cold water and completely washed with water. The filaments were tied together with a rubber band, and dried. The dried filaments were tufted into the head of a toothbrush using a LPB Tufting Machine manufactured by Tsujimura Co., Japan to obtain a toothbrush with highly tapered bristles which were between 8 mm to 9 mm in length from bristle root, with ends being between 0.01 and 0.03 mm in diameter.

COMPARATIVE EXAMPLE 2

A 98% sulfuric acid solution was placed into a 1000 ml beaker with a sandbath to fill by 1 cm from the bottom of the beaker. The temperature of the solution was kept at 120° C. A bundle of PBT(520) filaments, each being 0.2 mm in diameter, manufactured by TORAY CO., Japan, were cut to 35 mm in length. An 8 mm end of the bundle was soaked vertically in the solution. After 10 minutes passed from the soaking, a filament was picked up with a pincette and the melted end was observed with a magnifier at intervals of 2 minutes. After about 21 minutes passed from the soaking, the ends of the bristles were melted so that the length of the bristles was shortened. At that instant, the resulting highly tapered filaments were taken out from the solution. The filaments were cooled in cold water for 30 minutes. Subsequently, the opposite 8 mm ends of the filaments were treated in the same manner as above. Then, the highly tapered ends were soaked in a mixture of 30% sodium hydroxide solution and 0.5% acetone for 2 hours. The filaments, highly tapered at both ends, were cooled in cold water and several times washed with water. The filaments tied together with a rubber band, and dried. The dried filaments were tufted into the head of a toothbrush using a LPB Tufting Machine manufactured by Tsujimura Co., Japan to obtain a toothbrush with highly tapered bristles which were between 11 mm and 12 mm in length, with ends being between 0.01 and 0.03 mm in diameter.

EVALUATION

1. Loss in Product 50 toothbrushes (CJ) with tapered bristles prepared by the above EXAMPLES 1, 2 or 3 and 50 toothbrushes (CT) with highly tapered bristles prepared by the above COMPARATIVE EXAMPLES 1 or 2 were repeatedly examined by 2 experts in the field of toothbrush manufacturing. At least 90% of CT toothbrushes were evaluated useless since the highly tapered ends of bristles were not uniform. About 60% of highly tapered bristles made by the prior chemical tapering process is a loss. Therefore, a screening of inferior highly tapered bristles should be necessarily carried out prior to being tufted into toothbrushes. However, only two CJ toothbrushes were evaluated poor. Therefore, it is obvious that the present invention completely removes the losses incurred by the prior chemical tapering process.

2. Stiffness and Feeling during Brushing 10 candidates were allowed to use CJ toothbrushes made by the above EXAMPLE 2 for two weeks and CT toothbrushes with highly tapered bristles of 11 mm in length made by the above COMPARATIVE EXAMPLE 2 for the next two weeks. Prior to use, they were instructed to brush three times per day, each time for three minutes. About 1 g of Perio Toothpaste, manufactured by LG Chemicals, Korea, was used for every brushing. All candidates were questioned on the softness and the feeling every brushing. As a result, CJ toothbrushes were evaluated as more stiff and substantially better feeling during brushing than CT toothbrushes.

3. Duration

All toothbrushes were collected from the above candidates and the bristles were observed. As results, the bristles of CJ toothbrushes were substantially less deformed than the bristles of CT toothbrushes. It is evident that the highly tapered bristles of the present invention is more durable than the highly tapered bristles made by the prior chemical tapering process.

What is claimed is:

1. A tapered toothbrush bristle which is tapered starting at 10 mm or less from the end of the bristle, characterized in that the tapered end of the bristle ranges from 0.04 mm to 0.08 mm in diameter.

2. A toothbrush with tapered bristles each of which is tapered starting at 10 mm or less from the end of the bristle, with the tapered end of the bristle ranging from 0.04 mm to 0.08 mm in diameter.

* * * * *